US006281630B1

(12) United States Patent
English et al.

(10) Patent No.: US 6,281,630 B1
(45) **Date of Patent: *Aug. 28, 2001**

(54) VEHICLE LAMPS WITH GLARE CONTROL

(75) Inventors: George J. English, Reading, MA (US); Michael D. Tucker, Henniker, NH (US)

(73) Assignee: Osram Sylvania, Inc., Danvers, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/298,495

(22) Filed: Apr. 23, 1999

Related U.S. Application Data

(63) Continuation of application No. PCT/US98/08478, filed on Apr. 28, 1998.
(60) Provisional application No. 60/044,255, filed on Apr. 28, 1997.

(51) Int. Cl.[7] ..... H01J 5/16
(52) U.S. Cl. ..... 313/635; 313/578; 313/112
(58) Field of Search ..... 313/578, 580, 313/112, 272, 341, 635; 362/61, 84, 310

(56) References Cited

U.S. PATENT DOCUMENTS

| | | | | |
|---|---|---|---|---|
| 3,646,386 | | 2/1972 | Biinders | 313/115 |
| 3,736,452 | | 5/1973 | Biinders | 313/115 |
| 4,180,755 | | 12/1979 | Nixon, Jr. | 313/113 |
| 4,801,845 | * | 1/1989 | Kiesel | 313/272 X |
| 5,187,405 | | 2/1993 | Rachel et al. | 313/316 |
| 5,578,893 | | 11/1996 | Yamamoto | 313/112 |
| 5,808,399 | * | 9/1998 | Yoneyama | 313/272 X |
| 5,856,723 | * | 6/1999 | Rittner | 313/272 X |

FOREIGN PATENT DOCUMENTS

| | | |
|---|---|---|
| 1 589 412 | 3/1970 | (DE) . |
| 25 47 164 | 5/1976 | (DE) . |
| 0 500 340 A2 | 8/1992 | (EP) . |

OTHER PUBLICATIONS

Patent Abstracts of Japan, vol. 097, No. 003, Mar. 1997.

* cited by examiner

*Primary Examiner*—Ashok Patel
(74) *Attorney, Agent, or Firm*—Wolf, Greenfield & Sacks, P.C.

(57) ABSTRACT

A lamp capsule for use in a vehicle headlamp includes a lamp envelope having a tubular portion. First and second spaced-apart filaments are mounted in the lamp envelope for emitting light when energized by electrical energy. The lamp capsule further includes one or more light-attenuating axial stripes on the lamp envelope. The axial stripes are positioned on the lamp envelope for blocking light emitted by the first filament and reflected by the second filament. The lamp capsule may further include light-attenuating rings at or near opposite ends of the lamp envelope for defining upper and lower boundaries of a clear region of the lamp envelope. A filament support structure may include support leads located in the plane of the filaments for limiting light blockage and stray reflections.

22 Claims, 7 Drawing Sheets

VEHICLE LAMPS WITH GLARE CONTROL

CROSS-REFERENCE TO RELATED APPLICATION

This application is a continuation of International Application No. PCT/US98/08478, filed Apr. 28, 1998 which is a continuation of provisional application Serial No. 60/044,255, filed Apr. 28, 1997.

FIELD OF THE INVENTION

This invention relates to lamp capsules for vehicle headlamps and, more particularly, to lamp capsules which produce low glare in vehicle headlamp applications.

BACKGROUND OF THE INVENTION

Vehicle headlamps commonly include a lamp capsule mounted in a reflector so that the light source is located at or near the focal point of the reflector. Light emitted by the lamp capsule is directed in a forward direction by the reflector. The lamp capsule typically includes a high beam filament from which light is directed horizontally in a high beam pattern and a low beam filament from which light is directed below horizontal in a low beam pattern. One of the problems involved in the design and construction of vehicle headlamps is to minimize uncontrolled light emission outside the desired beam patterns, particularly the low beam pattern, that may impair the ability of oncoming drivers to see the road and other vehicles. This uncontrolled light is known as glare.

The typical low beam pattern requires that little or no light be projected above the horizontal plane and requires the maximum hot spot to be projected just below the horizontal plane. Factors such as filament size and internal and external uncontrolled reflections cause the source pattern to be spread, making a sharp transition line at the horizontal plane difficult to achieve. One approach is to aim the low beam pattern slightly lower than horizontal. This reduces glare for oncoming drivers but at the expense of reducing desired illumination far down the road. Another approach is to block undesired light. However, any blockage reduces the total illumination produced by the lamp and thereby reduces the effectiveness of the lamp. There is therefore a need to improve the low beam pattern and in particular to sharpen the transition line at the horizontal plane, while minimizing the adverse impact on the total illumination.

In a two-filament lamp capsule, light from the low beam filament falls on the high beam filament at close range, causing it to appear as if the high beam filament were illuminated at low level in the direction of the low beam filament. Regions not facing the low beam filament remain dark. Light reflected from the high beam filament is then projected onto the reflector and into the field of view. The light reflected from the high beam filament is projected by the reflector as if the high beam filament were partially illuminated and produces a ghost image of the high beam filament. Thus, light is projected above the horizontal plane into the region that should not receive light when the low beam filament is illuminated. It is desirable to reduce or eliminate this ghost image of the high beam filament during low beam operation without substantially affecting lamp intensity during high beam operation.

Vehicle headlamps include a filament support structure which supports the high beam and low beam filaments in desired positions in the lamp capsule and which conducts electrical energy to the filaments. The filament support structure typically includes conductive support leads having sufficient rigidity to support the filaments under all expected environmental conditions. The filament support structure should be configured to limit blockage of light emitted by the filaments and to limit stray reflections that would adversely affect the beam pattern. Furthermore, the positions of the filaments in the lamp envelope and relative to each other have a significant impact on the beam pattern and on the overall performance and flexibility of the lamp capsule.

SUMMARY OF THE INVENTION

According to a first aspect of the invention, a lamp capsule is provided. The lamp capsule comprises a lamp envelope including a tubular portion, a dome closing one end of the tubular portion and a seal closing the other end of the tubular portion, a first filament mounted in the lamp envelope for emitting light when energized by electrical energy, a second filament mounted in the lamp envelope in spaced relation to the first filament for emitting light when energized by electrical energy, and conductors for supplying electrical energy through the lamp envelope to the first and second filaments. The lamp capsule further comprises at least one light-attenuating axial stripe on the lamp envelope. The axial stripe is positioned on the lamp envelope for blocking light emitted by the first filament and reflected by the second filament.

Preferably, the first filament is mounted on or near a central axis of the lamp envelope and the second filament is spaced from the central axis. The lamp capsule may include first and second spaced-apart axial stripes that are parallel to the central axis of the lamp envelope. The first and second axial stripes may be equally spaced from a plane containing the first and second filaments. In one embodiment, the first and second axial stripes are spaced apart by about the projected diameter of the second filament on the lamp envelope. The first and second stripes may have widths that are approximately equal to the diameter of the second filament.

According to another feature of the invention, the lamp capsule may further comprise a light-attenuating ring on the lamp envelope adjacent to the seal for defining a lower boundary of a clear region of the lamp envelope. The lamp capsule may further comprise a light-attenuating layer on the dome and a light-attenuating ring on the lamp envelope adjacent to the light-attenuating layer for defining an upper boundary of the clear region.

According to a further aspect of the invention, a vehicle headlamp is provided. The vehicle headlamp comprises a reflector having a focal point, a lamp capsule and a lamp base for mounting the lamp capsule in the reflector. The lamp capsule comprises a lamp envelope, including a tubular portion and a dome closing one end of the tubular portion, first and second filaments mounted in the lamp envelope in spaced relationship for emitting light when energized by electrical energy, and at least one light-attenuating axial stripe on the lamp envelope. The axial stripe is positioned on the lamp envelope for blocking light, emitted by the first filament and reflected by the second filament, which would be reflected by the reflector above horizontal when the vehicle headlamp is mounted in a vehicle.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
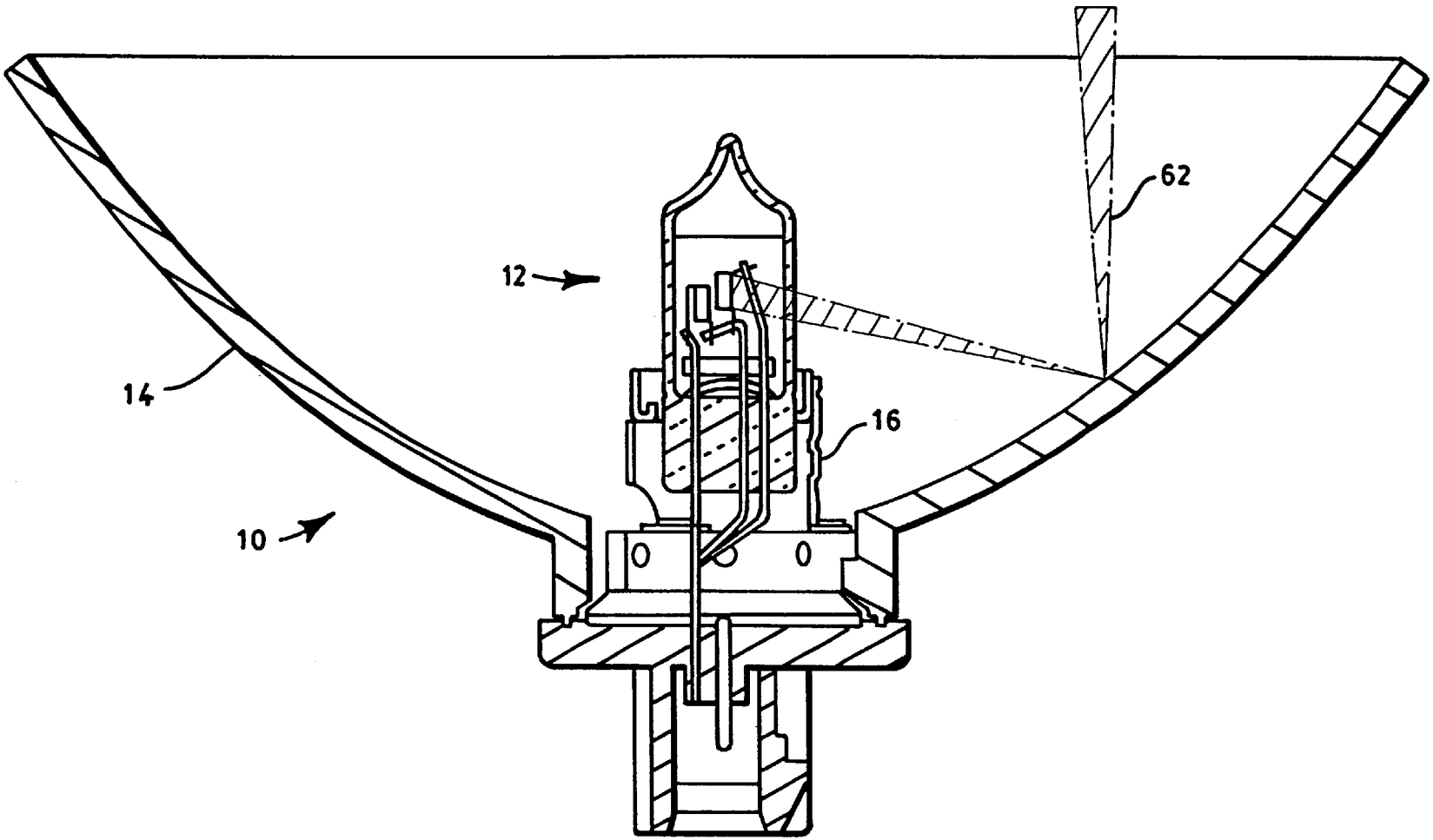
FIG. 1 is a cross-sectional side view of a vehicle headlamp assembly suitable for incorporation of the present invention.
Figure 2:
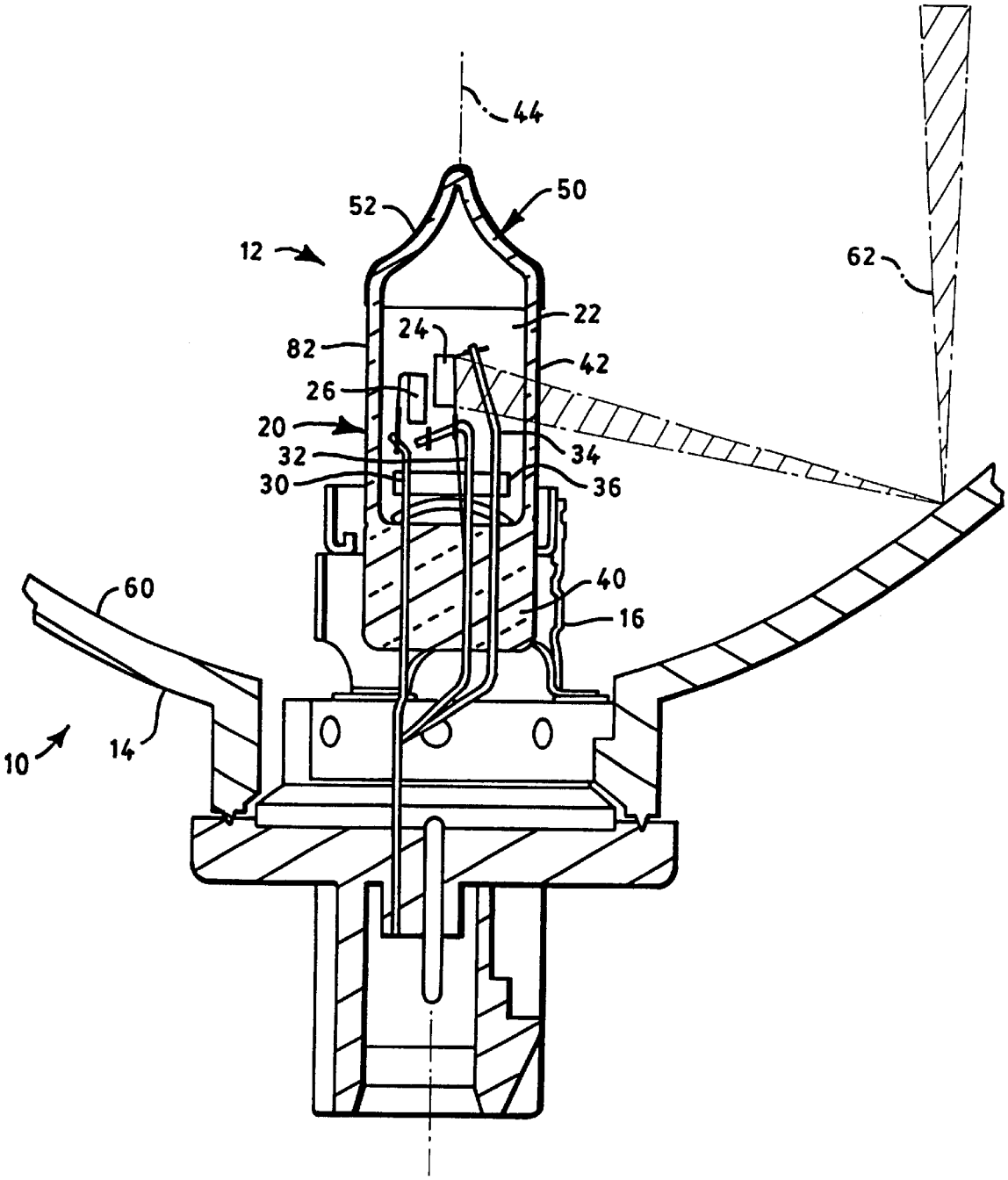
FIG. 2 is an enlarged, partial cross-sectional view of the headlamp assembly, showing the lamp capsule.

An example of a vehicle headlamp in accordance with the invention is shown in FIGS. 1 and 2. Like elements in FIGS. 1 and 2 have the same reference numerals. A vehicle headlamp 10 includes a lamp capsule 12 mounted within a reflector 14. A lamp base 16 mechanically mounts lamp capsule 12 in reflector 14 and supplies electrical energy to lamp capsule 12. The open side of reflector 14 is closed by a light-transmissive cover or lens (not shown).

Lamp capsule 12 includes a lamp envelope 20 of a light-transmissive material, such as glass, which defines an enclosed volume 22. A low beam filament 24 and a high beam filament 26 are mounted within lamp envelope 20. Conductive support leads 30, 32 and 34 provide mechanical support for filaments 24 and 26 and supply electrical energy to filaments 24 and 26. A lead frame 36 provides mechanical support for support leads 30, 32 and 34 and filaments 24 and 26. Leads 30, 32 and 34 pass through a press seal 40 of lamp envelope 20 and contact conductors in lamp base 16.

Lamp envelope 20 includes a generally tubular portion 42 having a central axis 44. The tubular portion 42 is closed at one end by a tip-off portion, or dome, 50 and is closed at the other end by press seal 40. In a preferred embodiment, dome 50 is shaped to trap light emitted by filaments 24 and 26 in the direction of dome 50 and to thereby reduce glare. A light-attenuating layer 52, such as black paint, covers the outside surface of dome 50 and prevents transmission of light through dome 50.

The reflector 14 has a reflecting surface 60 that may have one or more sections, each, for example, being a parabolic surface of revolution about an optical axis of the reflector. The lamp capsule 12 is positioned by base 16 such that filaments 24 and 26 are located at or near the focal points of the reflecting surface, and the central axis 44 of lamp envelope 20 is co-linear with the optical axis of reflector 14. Light emitted, for example, by filament 24 is reflected by reflecting surface 60 in a forward direction through an open side of reflector 14, as indicated by rays 62. Light emitted by filament 24 and reflected by reflecting surface 60 is directed nearly parallel to the optical axis of reflector 14 and produces a desired beam pattern. Similarly, light emitted by filament 26 is reflected by reflecting surface 60 in a forward direction and produces a desired beam pattern. Reflecting surface 60 may have different parabolic sections and may be complex. The reflecting surface may include more than one parabolic reflector. The lamp capsule of the present invention may be used with a variety of different reflector configurations.

Because filaments 24 and 26 are spaced apart within lamp envelope 20 and have different positions relative to the focal point of reflecting surface 60, they produce different beam patterns. Typically filament 24, which is located on or near the central axis of lamp capsule 12, is the low beam filament, and filament 26, which is spaced from filament 24 and is displaced axially toward press seal 40 relative to filament 24, is the high beam filament.

As indicated above, a partially illuminated image of the high beam filament may be produced in the beam pattern of the vehicle headlamp when the low beam filament is energized. The image, which is caused by light emitted by the low beam filament and reflected by the deenergized high beam filament, contributes to glare.

Figure 3:
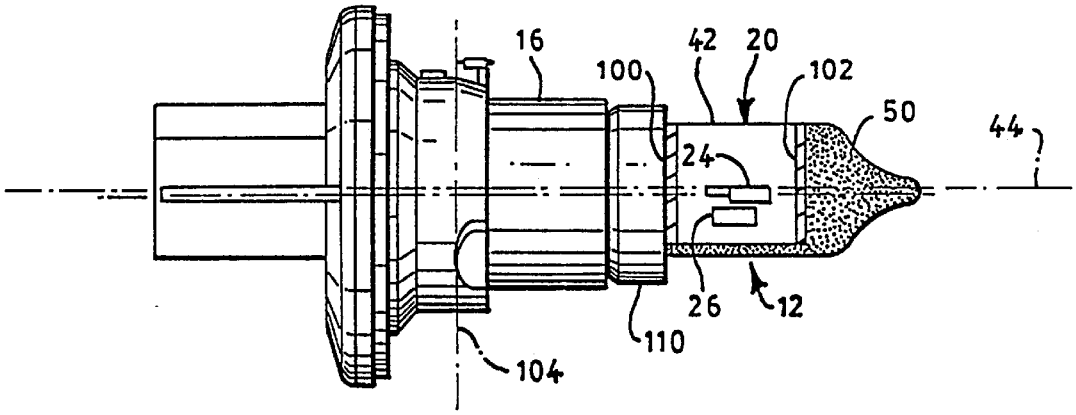
FIG. 3 is a schematic side view of the lamp capsule and lamp base of FIG. 1.
Figure 4:
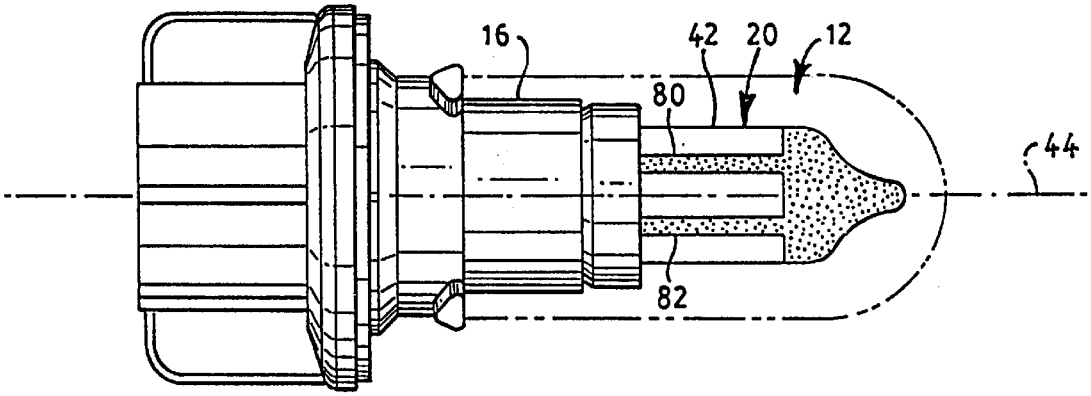
FIG. 4 is a schematic bottom view of the lamp capsule and the lamp base of in FIG. 3.
Figure 5:
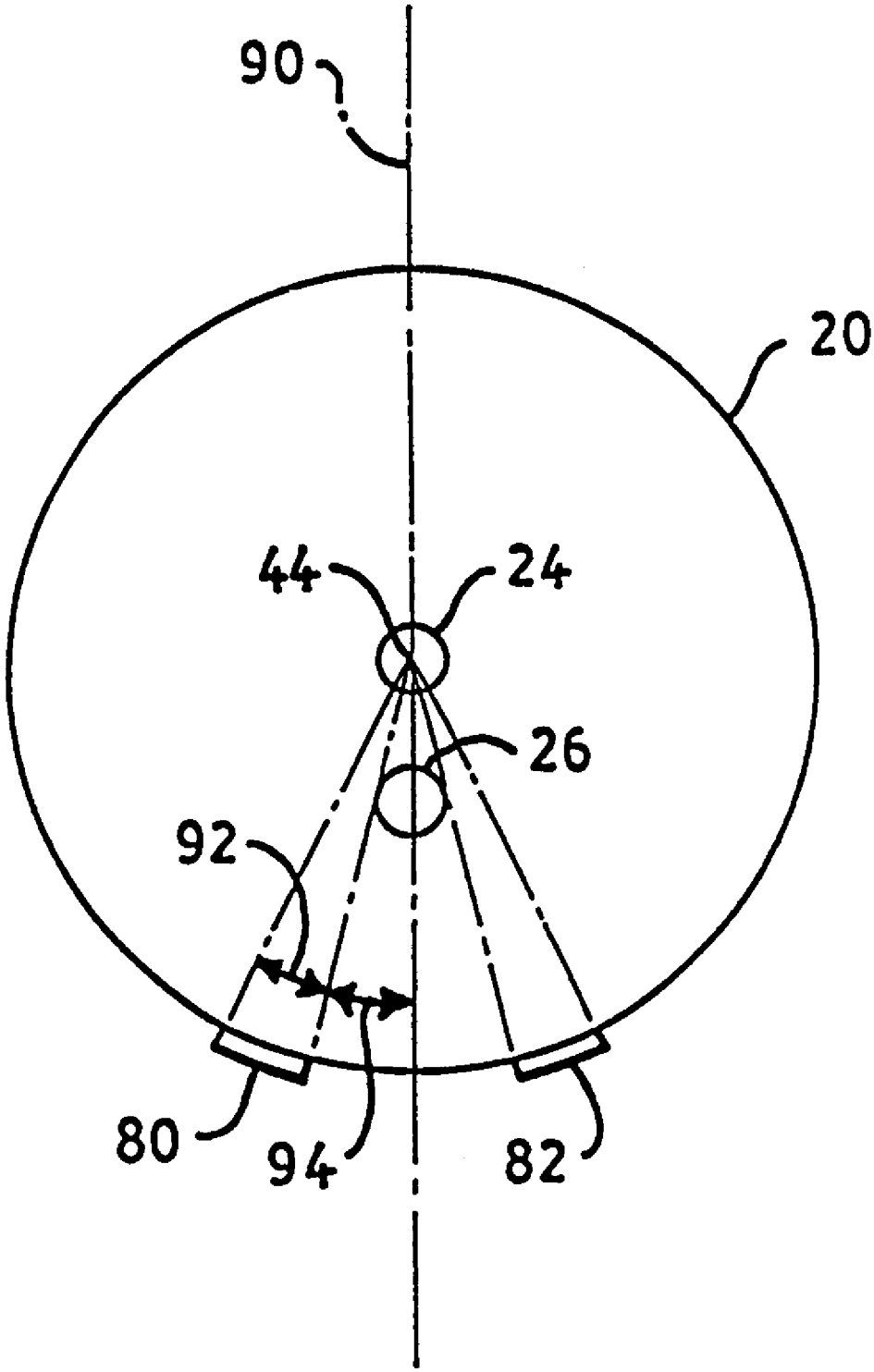
FIG. 5 is a schematic end view of the lamp capsule, illustrating the geometry of the axial stripes.

According to a feature of the invention, the lamp capsule 12 includes at least one light-attenuating axial stripe on the lamp envelope. An embodiment of the lamp capsule including axial stripes is illustrated in FIGS. 3–5. Like elements in FIGS. 1–5 have the same reference numerals. In the example of FIGS. 3–5, light-attenuating axial stripes 80 and 82 are provided on the outer surface of lamp envelope 20. Axial stripes 80 and 82 are spaced apart from each other and are substantially parallel to central axis 44 of lamp envelope 20. Axial stripes 80 and 82 preferably extend over the entire length of the tubular portion of lamp envelope 20. The axial stripes may be any material which is substantially opaque to the light emitted by low beam filament 24 and which is compatible with the environment of the vehicle headlamp. In a preferred embodiment, the axial stripes may be black paint.

The axial stripes 80 and 82 are positioned and dimensioned on lamp capsule 20 so as to reduce or eliminate the ghost image of the high beam filament when the low beam filament is illuminated, while minimizing the adverse impact on total illumination. More particularly, stripes 80 and 82 are positioned and dimensioned to block light, emitted by low beam filament 24 and reflected by high beam filament 26, which would be projected above the horizontal plane in the low beam pattern.

Suitable geometries of the light-attenuating axial stripes are described with reference to FIG. 5. As indicated above, at least one light-attenuating axial stripe is positioned on lamp envelope 20 to block light emitted by low beam filament 24 and reflected by high beam filament 26. In the example of FIG. 5, axial stripes 80 and 82 are equally spaced from a plane 90 containing filaments 24 and 26. Axial stripes 80 and 82 may be defined by angular widths relative to central axis 44 and angular spacings from plane 90. Preferably, each axial stripe is spaced from plane 90 by an angle 94 relative to central axis 44 in a range of about 17 to 20 degrees and has an angular width 92 relative to central axis 44 in a range of about 1 to 16 degrees. In one example, angle 94 is about 18 degrees and angle 92 is about 16 degrees. It may be observed that axial stripes 80 and 82 are approximately spaced by the projected diameter of high beam filament 26 on envelope 20. This may be understood from the fact that a region of lamp envelope 20 between axial stripes 80 and 82 is shadowed by filament 26 when filament 24 is illuminated. The widths of axial stripes 80 and 82 are selected to block light emitted by filament 24 and having grazing incidence on filament 26. It will be understood that it is not practical to block all light emitted by filament 24 and reflected by filament 26. In a preferred embodiment, axial stripes 80 and 82 have widths that are approximately equal to the diameter of filament 26. The axial stripes preferably extend the entire length of the tubular portion of the lamp envelope, but may have a shorter length within the scope of the invention.

In one example of a lamp capsule in accordance with the invention, lamp envelope 20 has an outside diameter of 0.580 inches and filaments 24 and 26 are spaced by 2.3 millimeters. Angle 92, representative of the width of axial stripes 80 and 82 is 16 degrees, and angle 94, representative of one half the spacing between axial stripes 80 and 82, is 18 degrees.

Tests of lamp capsules with and without light-attenuating axial stripes as described above have demonstrated that European standards for vehicle beam patterns can be achieved more easily when the axial stripes are used.

It will be understood that the width, position, number of stripes and length of stripes may be varied within the scope of the invention. The number of axial stripes, the length and width of each axial stripe and the position of each axial stripe on lamp envelope 20 are functions of the diameter of lamp envelope 20, the sizes of filaments 24 and 26, the spacing between filaments 24 and 26 and the acceptable reduction in total illumination produced by the axial stripes. The primary requirement is that one or more axial light-attenuating stripes be positioned to intercept at least a portion of the light emitted by the low beam filament and reflected from the high beam filament, with the high beam filament deenergized.

A further feature of the invention is described with reference to FIG. 3. Light-attenuating rings 100 and 102 are applied to the outer surface of lamp envelope 20. Light-attenuating ring 100 is located at the lower end of tubular portion 42 of lamp envelope 20 adjacent to base 16, and light-attenuating ring 102 is located at the upper end of tubular portion 42 adjacent to dome 50. Rings 100 and 102 control the length of a clear zone of lamp envelope 20 through which the light from filaments 24 and 26 can pass. The filaments 24 and 26 are located relative to a base reference plane 104 in the fabrication process. One or both of rings 100 and 102 may be utilized. The rings 100 and 102 may be added relative to the base as a completion step in the calibration of the light source. A metal cap 110 that surrounds the bottom portion of the lamp capsule acts as a primary baffle, with one or two rings added if necessary as an optional trim or final calibration. The light-attenuating layer on dome 50 may be calibrated by the addition of ring 102. The rings 100 and 102 may or may not be required, depending on the positioning of the edges of cap 110 and the coating on dome 50.

The masking of the filament ends with rings 100 and 102 generates filament images that have a sudden extinction of light. This permits fabrication of intensity patterns with a higher degree of control by portions of the reflector that have little, if any, control without these boundaries on the light transmitting area. The images from the region of the reflector close to the optical axis have a high degree of magnification that distorts and enlarges the filament image. Trimming one end of the distorted image permits control of a portion of the beam to the left of the vertical axis that can be used for horizontal aim. In addition, the trimmed images can be used to position the hot spot nearer to the horizon while limiting stray light above the horizon.

Figure 6:
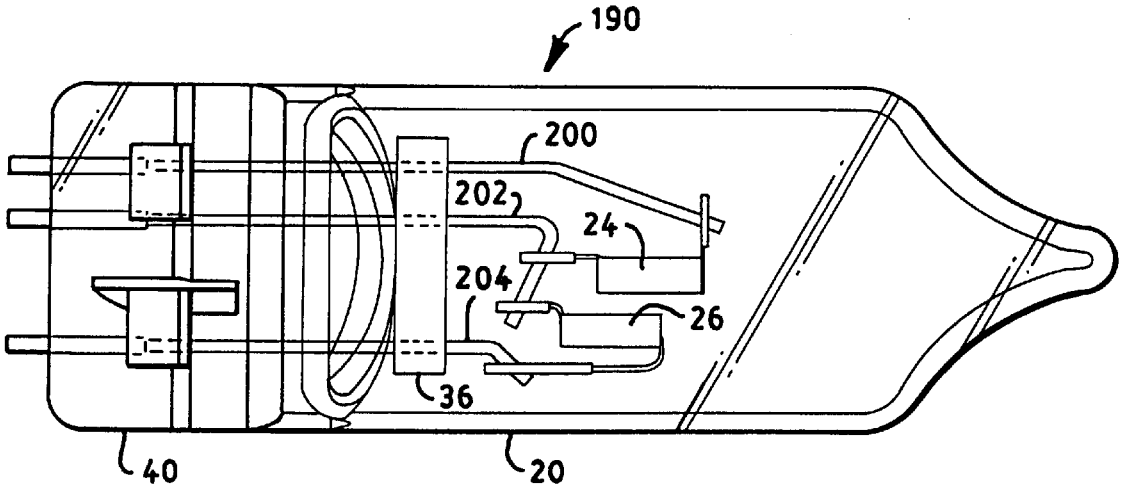
FIG. 6 is a side view of an embodiment of a lamp capsule in accordance with the invention.
Figure 8:
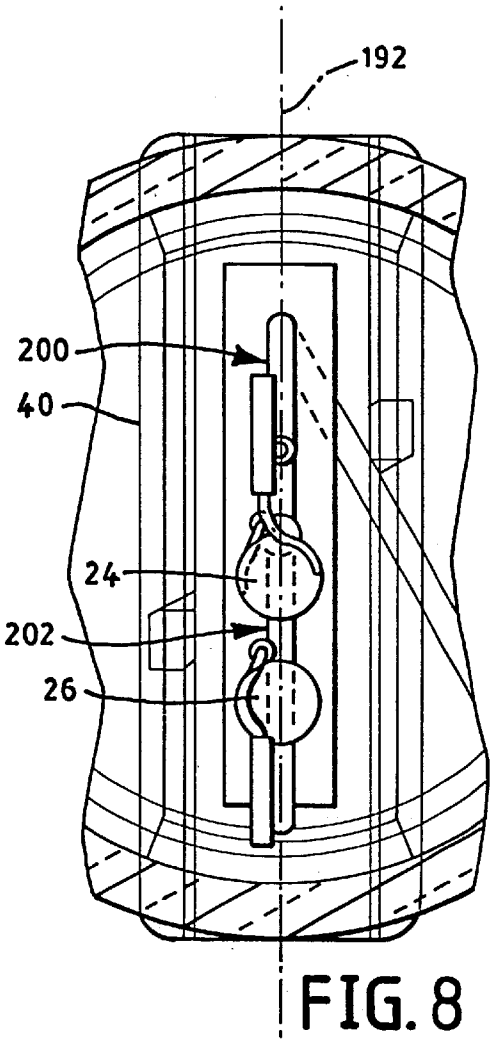
FIG. 8 is an end view of the filament support structure of FIG. 7.
Figure 7:
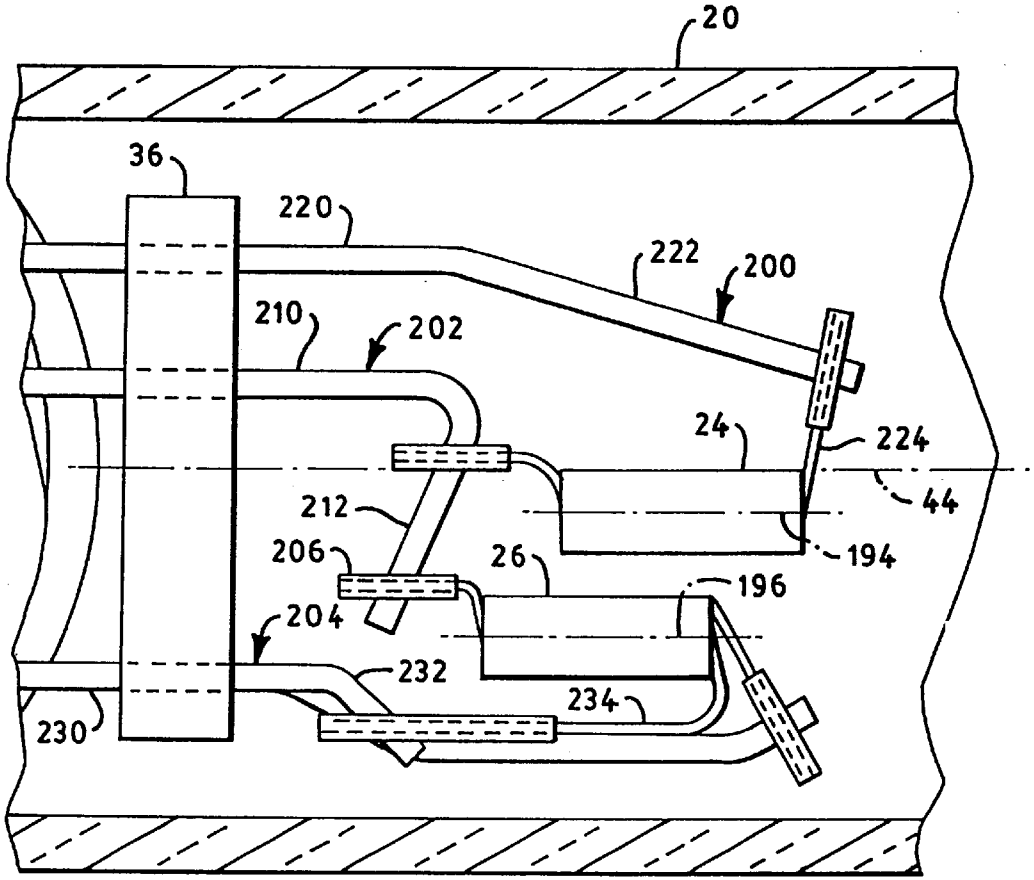
FIG. 7 is an enlarged, partial side view of the lamp capsule of FIG. 6, showing the filament support structure.

An additional feature of the invention is described with reference to FIGS. 6–9. Like elements in FIGS. 1–9 have the same reference numerals. A lamp capsule 190 is shown in FIGS. 6–8. Low beam filament 24 is displaced from central axis 44, typically by about 0.030 inch, to limit wall reflections. The high beam filament 26 is located in a plane defined by central axis 44 and low beam filament 24 and is displaced radially from low beam filament 24, typically by about 0.090 inch. More specifically, each of filaments 24 and 26 typically has a helical configuration. Filament 24 has a central axis 194, and filament 26 has a central axis 196. The respective central axes 194 and 196 of filaments 24 and 26 and central axis 44 of lamp envelope 20 are in a plane 192 (FIG. 8) and are parallel to each other. High beam filament 26 may be displaced axially toward press seal 40, typically by about one third of its length, with respect to low beam filament 24.

A support structure for filaments 24 and 26 includes support leads 200, 202 and 204, and lead frame 36. In a preferred embodiment, the portions of support leads 200, 202 and 204 within lamp envelope 20 are substantially coplanar with filaments 24 and 26. The plane 192 containing filaments 24 and 26, and support leads 200, 202 and 204 is preferably parallel to the long dimension of press seal 40, as best shown in FIG. 8. This configuration permits the lamp capsule to be rotated about low beam filament 24 for left hand drive and right hand drive applications, as described below. Furthermore, the disclosed filament and filament support structure facilitates manufacturing of the lamp capsule. The support structure for filaments 24 and 26 is configured for an improved beam pattern and reduced glare in comparison with prior art vehicle lamp capsules.

Each filament lead is preferably provided with a sleeve 206 of molybdenum. The sleeve 206 is attached to the filament lead by crimping and is welded to the respective support lead. Thus, where a filament lead is described as connected to a support lead, it will be understood that a sleeve is utilized.

Support lead 202 includes a lower segment 210 that is parallel to and spaced from central axis 44. An upper segment 212 of support lead 202 is bent in the plane of filaments 24 and 26 toward press seal 40, and is connected to the lower ends of filaments 24 and 26. Support lead 200 includes a lower segment 220 that is parallel to and spaced from central axis 44, and an upper segment 222 that is angled toward central axis 44 in the plane of filaments 24 and 26. The upper segment 222 of support lead 200 is connected to filament lead 224 near the upper end of low beam filament 24. Preferably, filament lead 224 is nearly perpendicular to central axis 44.

The angle of upper segment 222 of support lead 200, typically about 15° to 20°, is selected so that light emitted by low beam filament 24 is reflected downwardly by upper segment 222 when the lamp capsule is mounted in a vehicle lamp reflector. Because support lead 200 is located in the plane of filaments 24 and 26, support lead 200 is at least partially shadowed by filament 24 when high beam filament 26 is illuminated.

Support lead 204 includes a lower segment 230 that is parallel to and spaced from central axis 44, and an upper segment 232 that is bent away from central axis 44 in the plane of filaments 24 and 26. Upper portion 232 of support lead 204 is connected to filament lead 234 from the upper end of high beam filament 26. In the embodiment of FIGS. 6–8, filament lead 234 is bent toward press seal 40, and includes a section that is substantially parallel to central axis 44. The connection between filament lead 234 and the upper portion 232 of support lead 204 is made below filament 26 in a region between filament 26 and press seal 40. Filament lead 234 is preferably in the plane of filaments 24 and 26, and is at least partially shadowed by filament 26 when low beam filament 24 is illuminated. In addition, it may be observed that the support leads 202 and 204 for filament 26 are located in the region between filament 24 and press seal 40 and have minimal impact on light emitted by filaments 24 and 26. In general, support leads 200, 202 and 204 are configured to limit blockage of light emitted by filaments 24 and 26 and to limit stray reflections which would produce glare.

Figure 9:
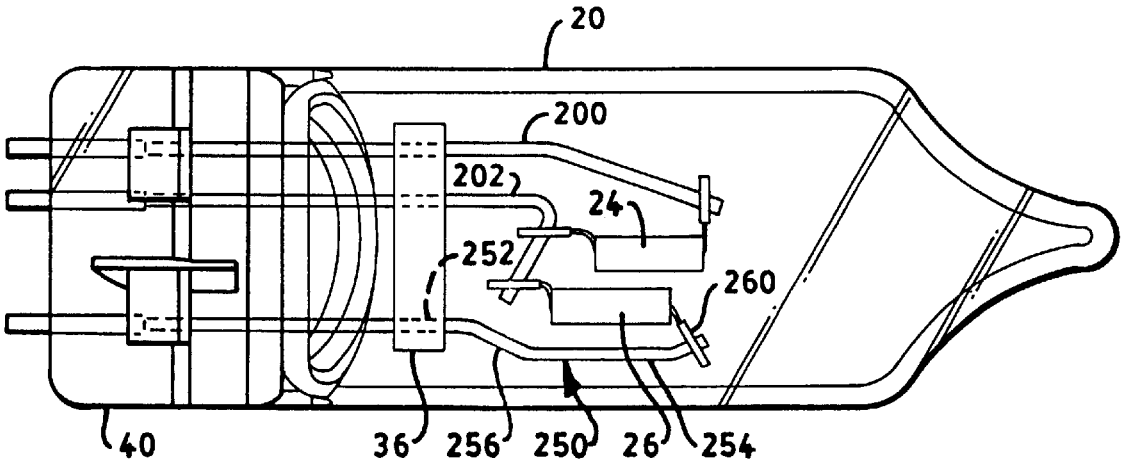
FIG. 9 is a side view of another embodiment of a lamp capsule in accordance with the invention.

An alternate embodiment of the filament support structure is shown in FIG. 9. Like elements in FIGS. 6–9 have the same reference numerals. The embodiment of FIG. 9 differs from the embodiment of FIGS. 6–8 primarily with respect to the support lead for the upper end of high beam filament 26. A support lead 250 includes a lower segment 252 parallel to and spaced from central axis 44, and an upper segment 254 parallel to central axis 44, but displaced outwardly in the plane of filaments 24 and 26 with respect to lower segment 252. Segments 252 and 254 are connected by an intermediate segment 256 disposed between filament 26 and press seal 40. An upper end of segment 254 may be bent inwardly and connected to a filament lead 260 of filament 26. Filament lead 260 may extend upwardly at an angle with respect to central axis 44. The segments of support lead 250 are in the plane of filaments 24 and 26. Upper segment 254 is shadowed by filament 26 when low beam filament 24 is illuminated, thus limiting light blockage and stray reflections.

Figure 10C:
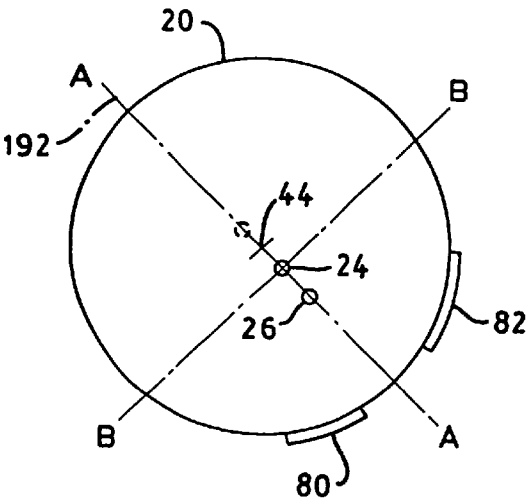
FIGS. 10A–10C are schematic end views of the lamp capsule in different rotational orientations.
Figure 10A:
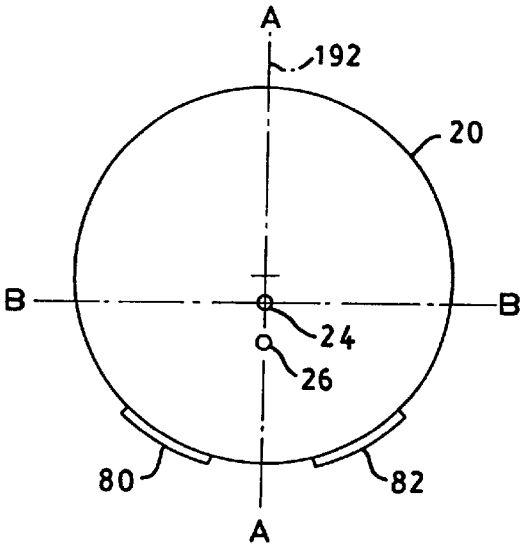
Figure 10B:
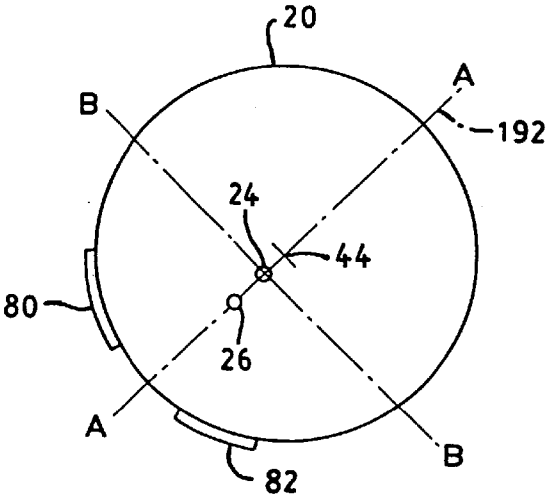

Schematic diagrams illustrating various orientations of the lamp capsule of the present invention are shown in FIGS. 10A–10C. Like elements in FIGS. 1–10C have the same reference numerals. FIGS. 10A–10C represent the lamp capsule as viewed along the central axis 44 of lamp envelope 20. In FIG. 10A, plane 192, which contains filaments 24 and 26 and is parallel to the plane of press seal 40, is oriented vertically. Axial stripes 80 and 82 are spaced from plane 90, as described above. In FIG. 10B, the lamp capsule is rotated by approximately 45 degrees in a clockwise direction about filament 24 with respect to the orientation of FIG. 10A. The orientation of FIG. 10B is used in a left hand driving vehicle headlamp. Axial stripe 80 reduces glare and provides a sharper transition at the upper boundary of the low beam pattern, as described above. In FIG. 10C, the lamp capsule is rotated approximately 45 degrees in a counterclockwise direction about filament 24 with respect to the orientation of FIG. 10A. The orientation of FIG. 10C is utilized in a right hand driving vehicle headlamp. Axial stripe 82 reduces glare and provides a sharper transition at the upper boundary of the low beam pattern, as described above.

It will be understood that the features of the lamp capsule described herein, including the use of one or more axial stripes on the lamp envelope, the use of one or more light-attenuating rings on the lamp envelope, and the filament support structure shown in FIGS. 6–9 and described above, may be used separately or in any combination to provide lamp capsules with improved beam patterns and ease of manufacture.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A lamp capsule comprising:

a lamp envelope including a tubular portion, a dome closing one end of said tubular portion and a seal closing the other end of said tubular portion, said lamp envelope having a central axis;

a first filament mounted in said lamp envelope for emitting light when energized by electrical energy;

a second filament mounted in said lamp envelope in spaced relation to said first filament for emitting light when energized by electrical energy;

at least one light-attenuating axial stripe on said lamp envelope, said axial stripe positioned on said lamp envelope for blocking light emitted by said first filament and reflected by said second filament; and conductors for supplying electrical energy through said lamp envelope to said first and second filaments.

2. A lamp capsule as defined in claim 1 wherein said axial stripe is substantially parallel to said central axis.

3. A lamp capsule as defined in claim 1 wherein said first filament is located on or near said central axis.

4. A lamp capsule as defined in claim 1 wherein said at least one light-attenuating axial stripe comprises first and second spaced-apart axial stripes.

5. A lamp capsule as defined in claim 4 wherein said first and second axial stripes are equally spaced from a plane containing said first and second filaments.

6. A lamp capsule as defined in claim 4 wherein said first and second axial stripes are positioned to intercept grazing reflections from said second filament.

7. A lamp capsule as defined in claim 5 wherein said first and second stripes are spaced from the plane of said first and second filaments by angles relative to said central axis in a range of about 17 degrees to 20 degrees.

8. A lamp capsule as defined in claim 5 wherein said first and second axial stripes are spaced from the plane of said first and second filaments by angles relative to said central axis of about 18 degrees.

9. A lamp capsule as defined in claim 4 wherein said first and second axial stripes have angular widths relative to said central axis in a range of about 1 degrees to 16 degrees.

10. A lamp capsule as defined in claim 4 wherein said first and second axial stripes have angular widths relative to said central axis of about 16 degrees.

11. A lamp capsule as defined in claim 1 wherein said lamp capsule further comprises a light-attenuating ring on said lamp envelope adjacent to said seal for defining a lower boundary of a clear region of said lamp envelope.

12. A lamp capsule as defined in claim 1 further comprising a light-attenuating layer on said dome and a light-attenuating ring on said lamp envelope adjacent to said light-attenuating layer for defining an upper boundary of a clear region of said lamp envelope.

13. A lamp capsule as defined in claim 4 wherein said first and second axial stripes are spaced apart by about a projected diameter of said second filament on said lamp envelope.

14. A lamp capsule as defined in claim 4 wherein said first and second stripes have widths approximately equal to a diameter of said second filament.

15. A vehicle headlamp comprising:

a reflector having a focal point;

a lamp capsule comprising a lamp envelope including a tubular portion, a dome closing one end of said tubular portion and a seal closing the other end of said tubular portion, said lamp envelope having a central axis, first and second filaments mounted in said lamp envelope in spaced relationship for emitting light when energized by electrical energy, and at least one light-attenuating axial stripe on said lamp envelope, said axial stripe positioned on said lamp envelope for blocking light, emitted by said first filament and reflected by said second filament, which would be reflected by said reflector above horizontal when said vehicle headlamp is mounted in a vehicle; and a lamp base for mounting said lamp capsule in said reflector with said first filament positioned at or near said focal point and for supplying electrical energy to said first and second filaments.

16. A vehicle headlamp as defined in claim 15 wherein said at least one light-attenuating axial stripe comprises first and second spaced-apart axial stripes that are substantially parallel to said central axis.

17. A vehicle headlamp as defined in claim 16 wherein said first and second axial stripes are equally spaced from a plane containing said first and second filaments.

18. A vehicle headlamp as defined in claim 15 wherein said lamp capsule further comprises a light-attenuating ring on said lamp envelope adjacent to said seal for defining a lower boundary of a clear region of said lamp envelope.

19. A vehicle headlamp as defined in claim 15 further comprising a light-attenuating layer on said dome and a light-attenuating ring on said lamp envelope adjacent to said light-attenuating layer for defining an upper boundary of a clear region of said lamp envelope.

20. A lamp capsule comprising:

a lamp envelope including a tubular portion and a dome closing one end of said tubular portion, said lamp envelope having a central axis;

first and second filaments mounted in said lamp envelope in spaced relationship for emitting light when energized by electrical energy;

first and second spaced apart light-attenuating axial stripes on said lamp envelope, said first and second axial stripes equally spaced from a plane containing said first and second filaments for blocking light emitted by said first filament and reflected by said second filament when said second filament is deenergized; and conductors for supplying electrical energy through said lamp envelope to said first and second filaments.

21. A lamp capsule comprising:

a lamp envelope including a tubular portion, a dome closing one end of said tubular portion and a seal closing the other end of said tubular portion, said lamp envelope having a central axis;

a light source mounted in said lamp envelope for emitting light when energized by electrical energy;

a light-attenuating ring on said lamp envelope adjacent to said seal for defining a lower boundary of a clear region of said tubular portion; and conductors for supplying electrical energy through said lamp envelope to said light source.

22. A lamp capsule as defined in claim 21 further comprising a second light-attenuating ring on said lamp envelope adjacent to said dome for defining an upper boundary of the clear region of said lamp envelope.

* * * * *